United States Patent [19]

Hyler

[11] 3,950,866

[45] Apr. 20, 1976

[54] ELEVATING-TYPE SCRAPER HAVING FORWARDLY SWINGABLE APRON AND FULL WIDTH PIVOTED STRIKER

[75] Inventor: John H. Hyler, Peoria, Ill.

[73] Assignee: Westinghouse Air Brake Company, Pittsburgh, Pa.

[22] Filed: Dec. 23, 1974

[21] Appl. No.: 535,943

[52] U.S. Cl. ..... 37/8; 37/126 AC

[51] Int. Cl.[2] ..... B60P 1/36

[58] Field of Search ..... 37/8, 126, 129, 127

[56] References Cited

UNITED STATES PATENTS

| | | | |
|---|---|---|---|
| 3,474,547 | 10/1969 | Campbell et al. | 37/8 |
| 3,483,640 | 12/1969 | Anderson et al. | 37/8 |
| 3,484,960 | 12/1969 | Kokaly et al. | 37/8 |
| 3,660,914 | 5/1972 | Bechman et al. | 37/126 AC |

*Primary Examiner*—Stephen C. Pellegrino
*Attorney, Agent, or Firm*—Wolfe, Hubbard, Leydig, Voit & Osann, Ltd.

[57] ABSTRACT

An elevating-type scraper for earth-moving purposes having an open fronted bowl which includes a pair of spaced vertical side sheets, back wall and floor, the bowl being supported by a pair of draft members extending from the tractor-supported draft frame. An apron extends transversely between the side sheets in the front portion of the bowl and carries a scraper blade. An elevator is rearwardly inclined over the apron for conveying loosened soil from the blade into the bowl. A strike-off member is hinged, in fixed position, to the front edge of the floor to the rear of the apron. The apron is pivoted to the bowl for forward swinging movement to actuate the striker and to create sizable discharge opening ahead of the floor for dumping of the material collected in the bowl, the discharged material being leveled smoothly over the entire bowl width. It is a feature of the construction that a small amount of apron movement suffices to swing the scraper blade clear of the ground so that upon controlling the tilt of the bowl the striker blade may perform a shallow fullwidth scraping and "clean up" function, scraping up soil into the bowl which is then acted upon by the elevator to cause the soil to be deposited at the rear of the bowl and permitting more finished and accurate contouring. A cam or stop mechanism is interposed between the apron and the strike-off member so that the latter is completely released to assume its working position during the initial portion of movement of the apron and is moved to horizontal transport position during the final restoring movement of the apron. Means are provided on the apron for swinging the elevator upwardly to keep the same clear of the apron as the latter swings forwardly and upwardly.

24 Claims, 8 Drawing Figures

5
5
GROUND LEVEL
d
20
22
23
24
26
25
94
91
90
93
92
95
130
132
133
131
135
134
71
81
80
82
70
72
73
74
42
142
116
116a
108
112
102
104

ELEVATING-TYPE SCRAPER HAVING FORWARDLY SWINGABLE APRON AND FULL WIDTH PIVOTED STRIKER

BACKGROUND OF THE INVENTION

The invention relates generally to an earth-moving device in the form of a tractor-scraper into which soil is propelled by an elevator and which has improved means for scraping the soil and dumping the soil when the scraper bowl is filled.

In many conventional types of scrapers of the elevator type the scraper blade is used both for scraping soil up into the bowl for transport and for leveling or strike-off purposes when the soil is subsequently dumped. Where the scraper blade extends the full width of the bowl and is intended to take a relatively shallow cut the same blade can be used satisfactorily for both scraping and leveling purposes. For example, in some scrapers the scraper blade is secured to the forward edge of a moving floor section. The section is slid rearwardly in the bowl in order to provide a discharge opening, with the blade, during discharge, performing its leveling function.

However, the modern tendency, for more efficient scraping and elevation, is to employ a scraper blade which is much narrower than the width of the bowl and which digs much more deeply, even being provided with projecting ripper teeth to loosen the subsoil. Such blades, when used for strike-off, are, of course, incapable of even or full-width leveling.

In some conventional elevator type scrapers the scraper blade is mounted upon a blade base which is fixed at the front end of the bowl and is an integral part of the bowl structure. In such devices, using a sliding floor section, a separate striker blade is mounted at the front edge of the floor section and serves to level the material which is discharged as the floor section is retracted. This provides the desired full width leveling but any attempt to distribute the discharged soil in a thin layer by lowering of the bowl level has serious clearance problems since the scraper blade, being a fixed part of the bowl, must also be lowered into ground engagement. It is obviously undesirable to be digging furrows in the ground at the same time that one attempts to do finished leveling.

Moreover, wherever the strike-off or leveling function is accomplished by a blade which is secured to the front edge of a slidable floor section, soil cannot be spread to a constant depth. The reason for this is that in retracting the floor section gradually to produce gradual discharge of the contained material, the floor section is guided along a track which is not horizontal but which has a slope depending upon the existing degree of tilt of the bowl, resulting in the spreading of a layer soil of constantly increasing thickness as the movable floor section is gradually retracted.

There are other serious problems in the use of slidable floor sections. The discharge opening is usually only a small fraction of the bottom area of the bowl. While discharge takes place satisfactorily in the case of soils which are relatively dry and friable, obtaining discharge of wet clayey soils is an entirely different matter. The soil in the bowl is, in the usual design of scraper, pressed forwardly toward the discharge opening by an ejector plate. Clay inherently resists ejection and, instead, tends to expand laterally against the side sheets of the bowl and to move forwardly into a jamming position against the flights of the elevator so that instead of smooth discharge there is a condition of "hang-up" which often requires that scraping be discontinued until the earth loses some of its moisture, at considerable loss to the contractor. Moreover, the use of sliding floor sections is accompanied by certain mechanical disadvantages, one being that a floor section is guided on rollers in tracks which are located so low in the structure as to be subject to heavy abuse when pulled over large boulders or abrasive materials. Moreover the tracks, being in exposed position, are susceptible to clogging by clay, rocks and foreign matter and when obstruction of the tracks is unbalanced, as is usually the case, the sliding floor section may become cocked and inoperative.

Similarly the actuators used for operating the movable floor section must be mounted low in the structure in a position to exert pressure in line with the tracks, and such actuators are, therefore, vulnerable to damage by casual ground obstructions. Where such actuators are, instead, mounted behind the ejector plate they create space and accessibility problems, especially where a rear driving engine is employed.

SUMMARY OF THE INVENTION

It is, accordingly, an object of the present invention to provide an elevator type scraper having improved discharge and leveling characteristics and which avoids the operational and mechanical problems which have characterized conventional scrapers, particularly those employing a sliding floor section.

It is, more particularly, an object of the present invention to provide an elevating-type scraper which avoids use of a sliding floor section, which provides separate blades for scraping and strike-off, and which uses a swingable apron mounting the scraper blade, with provision for swinging the apron forwardly to remove the scraper blade from the ground while creating a large opening at the bottom of the bowl for discharge of the contained material, a pivoted strike-off blade being provided in fixed position along the rear edge of the opening for full width leveling of the discharged material. Because of the retraction of the scraper blade, and the ripper teeth which are often a part of the blade structure, from the ground, no furrows are dug in the ground during the striking and leveling operation. It will be apparent, too, that with the scraper blade out of the way, clearance problems are avoided and the bowl may be tilted to bring the striker blade as close to the ground as may be desired for the leveling of soil in a very thin layer.

In carrying out the present invention, an apron is provided in the front portion of the scraper bowl and extending between the side sheets, the apron mounting a scraper blade capable of taking a deep cut and occupying only the central portion of the apron and with an elevator of substantially the same width as the blade being inclined upwardly and rearwardly over the apron for conveying loosened soil in the bowl.

Hinged to the front edge of the floor of the bowl is a strike-off member having a striker blade which extends substantially the full width of the bowl and which is swingable from a horizontal transport position to a downwardly angled working position, the floor, strike-off member and apron together serving to enclose the bottom of the bowl. The apron is pendulously pivoted for forward swinging movement, such swinging movement serving to drop the strike-off member to its working position and to swing the scraper blade at the front end of the apron out of the ground, with continued movement of the apron opening a large area of the bowl bottom for discharge of the contained material which is then leveled by the full width striker blade.

The strike-off member is free to move into working position during the initial portion of the forward swinging movement. The center radius of swing is such that even during such initial movement the scraper blade moves clear of the ground. The initial movement causes the apron to occupy what may be conveniently termed a "cracked open" position. While means are provided for swinging the elevator upwardly in unison with the apron, the elevator, when the apron is thus cracked open, still occupies a sufficiently low position as to be operative. Accordingly, the striker blade may be used as a full-width scraper blade by tilting the bowl forwardly to bring the blade into shallow scraping contact with the ground, with the scraped soil thereafter being acted upon by the elevator so that it is deposited in the rear of the bowl. Accordingly, the structure is capable of two distinct modes of scraping operation, a first mode in which the regular scraper blade on the apron is used to scrape deeply and efficiently, but over a narrow width, and a second mode in which the apron is swung forwardly to disengage the regular scraper, also to drop the strike-off member, permitting the striker blade to be further lowered, by tilting of the bowl, into light scraping engagement which is valuable for final contouring and clean-up.

By swinging the apron fully to its forward position the elevator, moving in unison therewith, is disengaged and the soil in the bowl is free to flow through the discharge opening. Since the regular scraper blade now occupies a completely out of the way position, the striker blade may be lowered, by tilting of the bowl, to establish distribution of the soil in a layer as thin as may be desired.

DETAILED DESCRIPTION OF THE PREFERRED EMBODIMENT

Figure 1:
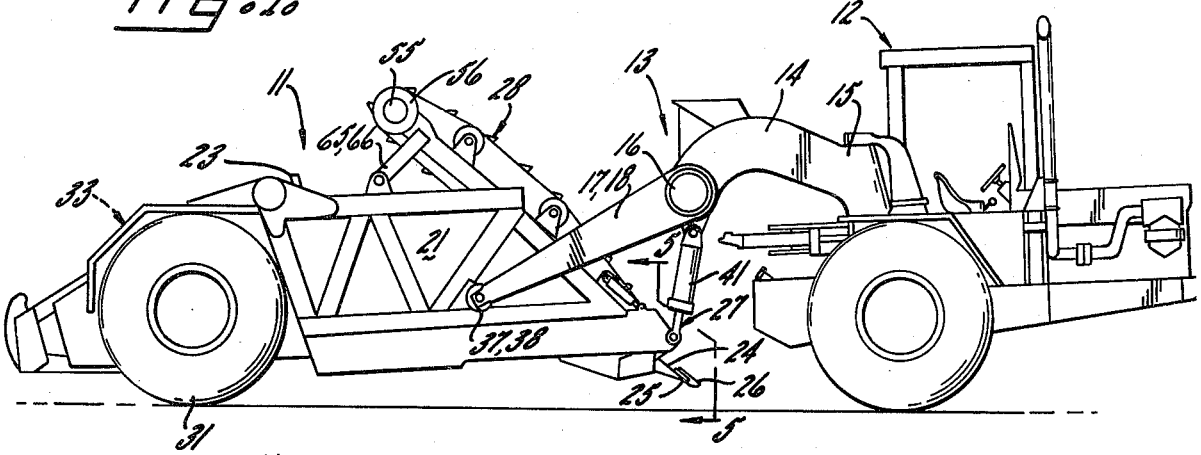
FIG. 1 is a side elevation of a complete elevating scraper assembly, including a tractor, to which the present invention has been applied.
Figure 3:
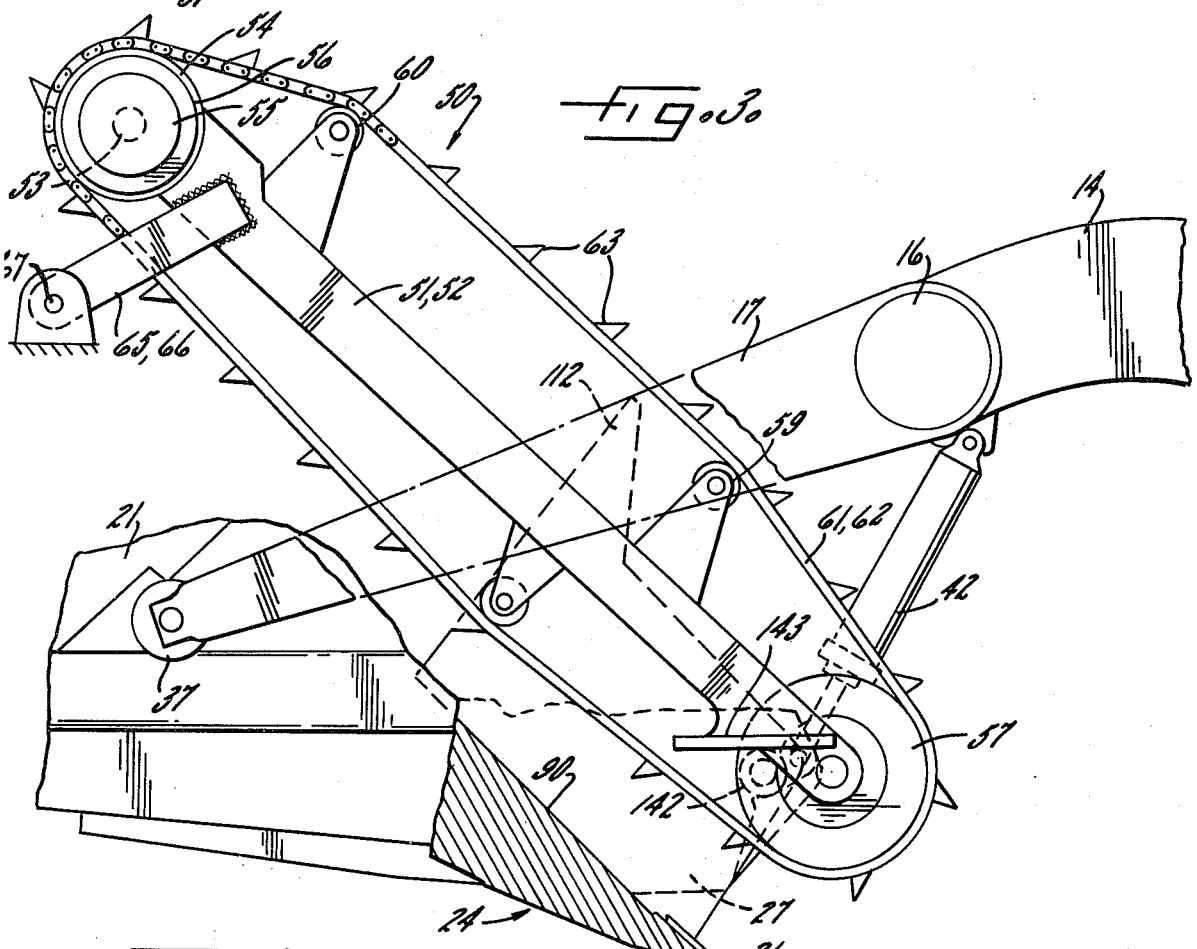
FIG. 3 is a fragmentary view showing a side elevation of the elevator and the means for coupling the elevator to the apron for swinging movement in unison.

Referring now to the drawings there is disclosed a scraper assembly having a bowl 11 and tractor 12 interconnected by a draft frame 13. The draft frame includes a so-called gooseneck 14 which is of rigid construction pivoted to the tractor at 15 for horizontal swinging movement and carrying a torque tube, or yoke tube, 16, to the lateral ends of which are rigidly secured draft members 17, 18. Bowl 11 has side sheets 21, 22 and a back wall 23. Located at the front of the bowl is an apron 24 to which more detailed reference will be made and which mounts a cutter blade 25 with ripper teeth 26. The bowl has an open front 27 occupied by an elevator generally indicated at 28.

The rear end of the bowl structure is supported upon rubber-tired wheels 31, 32 driven by an engine 33 mounted between them. The forward portion of the bowl is supported by pivotal engagement, at 37, 38, with the rear ends of the draft members 17, 18. The running level of the blade is controlled by actuators 41, 42, also referred to as bowl hoist cylinders, which are interconnected between the ends of the torque tube and the front corners of the bowl structure. By extending the actuators 41, 42, the bowl is rocked clockwise as viewed in FIG. 1, lowering the scraper blade and ripper teeth to a predetermined depth of cut.

Mounted transversely at the open front end of the bowl is the elevator 28 having spaced frame members 51, 52 which occupy a rearwardly inclined position. Extending between the frame members is a top drive shaft 53 having sprocket wheels 54. The shaft 53 is rotated by a motor 55 having a gear box 56. In alined position at the lower end of the elevator frame are rollers 57, additional guidance being provided by idler rollers 59, 60. Engaging the sprockets and trained about the rollers are respective conveyor chains 61, 62 having flights 63.

It will be apparent, then, as motor 55 is rotated, the underside of the elevator engages the soil which has been loosened by the blade 25, propelling it back into the bowl. For the purpose of permitting upward swinging movement of the elevator, the frame members 51, 52 are supported upon rigid arms 65, 66 having a swing axis 67. This not only enables the elevator to yield upwardly upon encountering a boulder or other obstruction, but permits the elevator to be swung upwardly to preserve a predetermined clearance relationship between the elevator flights and the apron. The means for securing movement in unison will be described.

Figure 2:
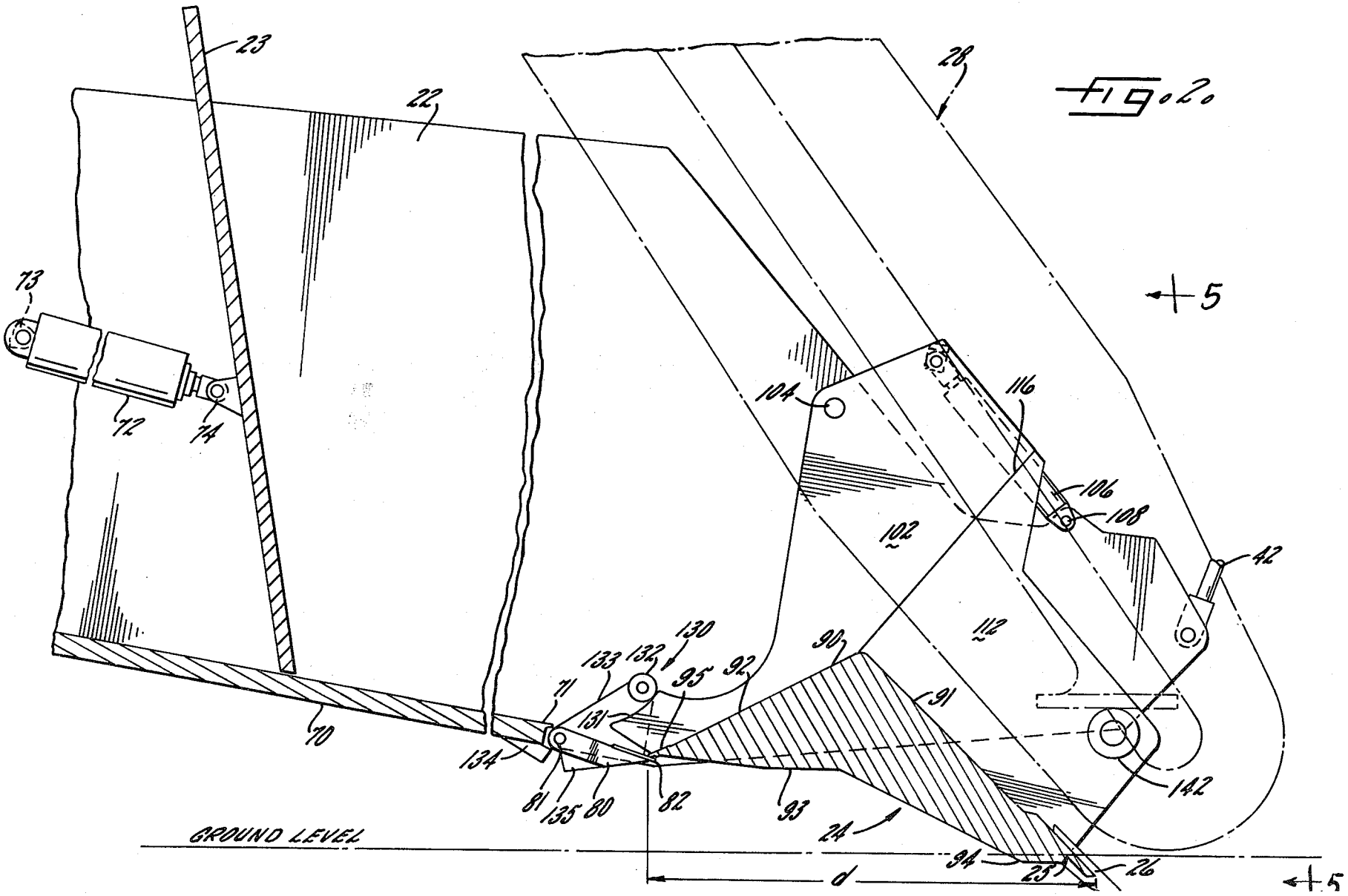
FIG. 2 is a vertical longitudinal section taken through the bowl showing the apron and blade in digging position with the profile of the elevator shown in dot-dash outline, in lowest position.

Referring next to the floor of the bowl, as shown in FIG. 2, the floor may take dififerent forms without departing from the present invention. However, in the preferred embodiment I use a fixed floor 70 to span the distance between the side sheets in the rear portion of the bowl, the floor 70 having a front edge 71. Where a fixed floor section is used I provide a back wall 23 in the form of a movable ejector plate for pressing the contained soil forwardly to a point of discharge at the front of the bowl. Since use of a fixed floor and ejector plate is per se conventional, it will be understood that any suitable ejecting means may be used as, for example, an actuator 72 which is secured to suitable frame structure 73 at its rear end and which makes a connection 74 with the ejector plate 23 at its forward end.

Figures 4, 5:
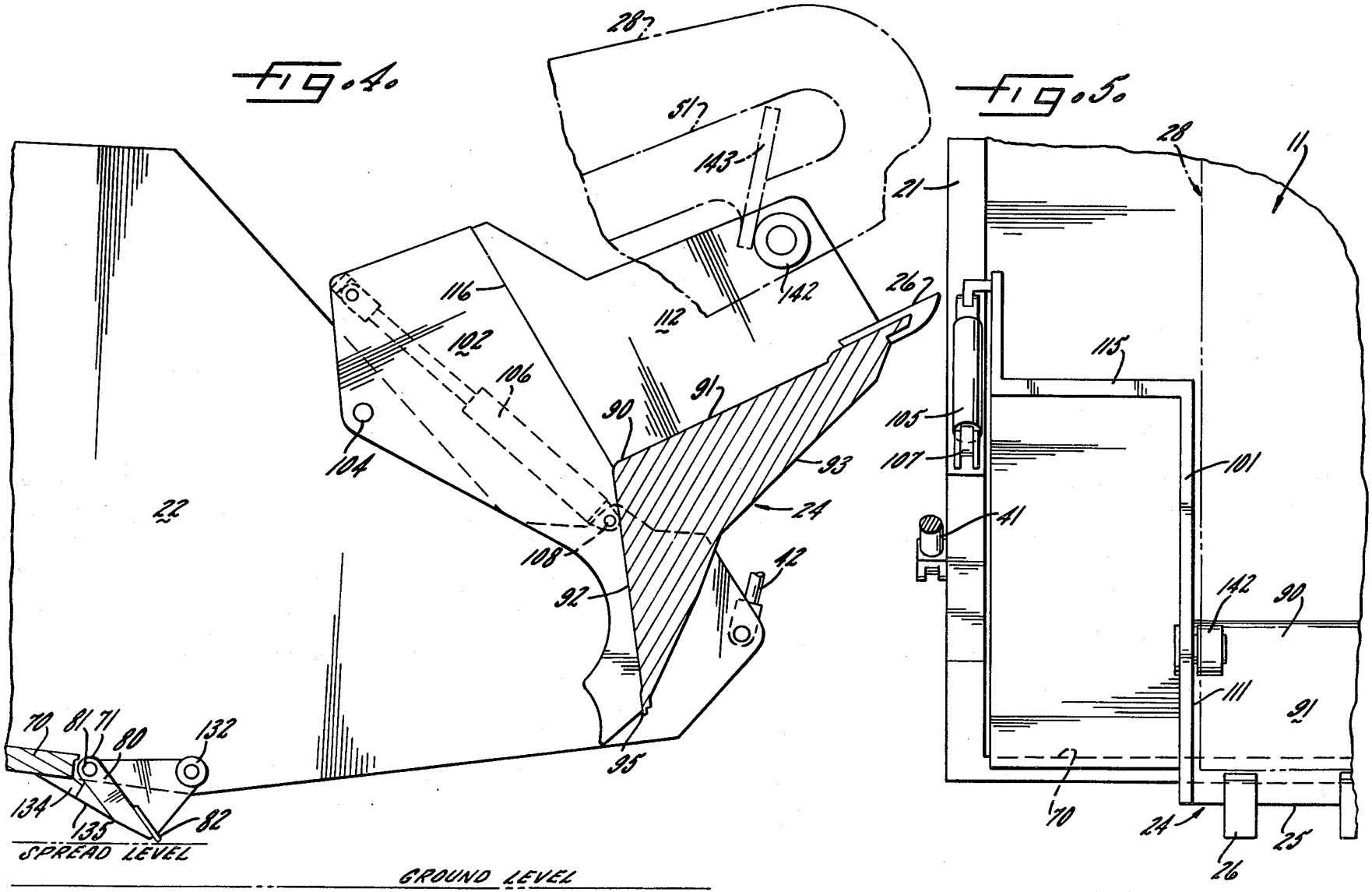
FIG. 4 is a view similar to FIG. 2 but showing the apron swung fully forward for discharge, with the striker blade in working position and with the elevator swung upwardly as indicated by the dot-dash outline.
FIG. 5 is a fragmentary front view taken along the line 5—5 in FIG. 2.

Hinged to the front edge of the fixed floor 70 is a pivoted strike-off member 80 having a hinge axis 81. The strike-off member 80, it will be understood, extends full width of the bowl and carries at its tip a full width striker blade 82 which is utilized both for leveling discharged dirt and, under some circumstances, as a scraper blade as will be described. The working position of the strike-off member 80 is illustrated in FIG. 4.

In accordance with the present invention, the apron 24 which carries the scraper blade 25 and ripper teeth 26 forms a portion of the floor structure. The apron body, or blade base, 90 is of shallow triangular cross section, having a forwardly sloping surface 91, a rearwardly sloping surface 92 and a relatively flat undersurface 93. The dimension *d*, measured longitudinally between the leading edge 94 which mounts the blade and the trailing edge 95 which mates with the strike-off member 80 under transport conditions, is greater than usually employed for a blade base. While the dimension *d* will usually be less than the longitudinal dimension of the fixed floor, nevertheless it should be a major portion of the floor dimension and, combined with the fore and aft dimension of the strike-off member, is effective to produce a discharge opening of substantial size.

In carrying out the invention the apron 24 is mounted pendulum-fashion upon a pair of side plates 101, 102 which lie closely adjacent the inside surfaces of the side sheets 21, 22, respectively, and which are pivoted thereto by elevated and alined pivots 103, 104. The side plates 101, 102, while of irregular shape, are essentially sector-like and are rigidly connected along their lower edges to the ends of the apron body 90 by welding to produce a rigid, cradle structure. For rocking the apron fore and aft between its closed and open positions, actuators 105, 106 are provided, the actuators being anchored, at their lower ends, to the respective side sheets at points 107, 108.

The geometry of the apron 24 is such that when it is in its normal working condition the body 10, of triangular cross section, is, as will be seen in FIG. 2, forwardly and downwardly tilted, so that the blade 25, and teeth 26 thereon, occupy a low level with the surface 91 and blade at an optimum scraping angle.

Figure 6:
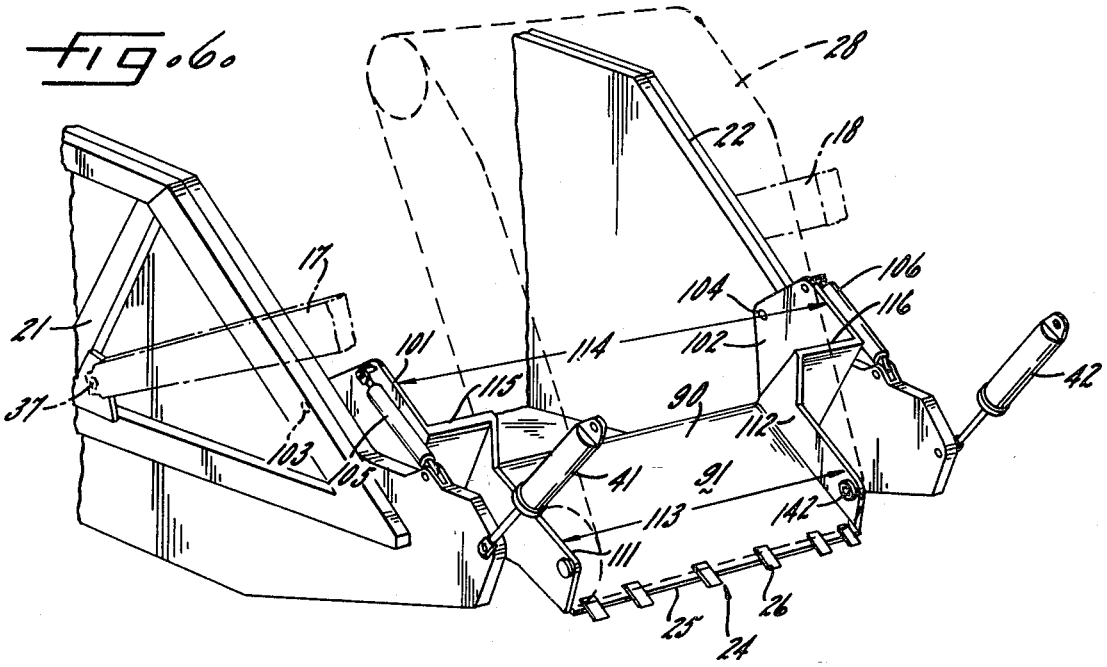
FIG. 6 is a perspective view of the apron and scraper blade in digging position, with the elevator shown in dotted outline.

While the present invention is not limited to use of a blade 25 of any particular width, I prefer in the present structure to use a deep digging blade of narrow width, compared to the bowl width, and an elevator of corresponding dimension. To this end I provide, as an integral part of the apron, vertical guide plates 111, 112 (see FIG. 6) which are generally parallel to the corresponding side plates 101, 102 and which are spaced inwardly therefrom to define between them a relatively narrow central opening 113 coextensive with the sloping front surface 91 of the apron body and which registeringly receives the elevator 28. By contrast the sloping rear surface 92 extends full width between the side plates 101, 102 as indicated at 114. By dimensioning the blade 25 to take a narrow cut, by making the elevator 50 of correspondingly narrow width, and by guiding the loosened soil between the guide plates 111, 112, to provide a "shovel front", a greater cubic yardage of loosened soil may be deposited in the bowl per unit of time than where a wide shallow cut is taken. Moreover, because the sloping rear surface 92 extends full width, the soil is free to spread out in the space behind the elevator. The offset or "jog" between the side plates 101, 102 and the guide plates 111, 112 is preferably bridged by transversely extending closure plates 115, 116 which not only prevent spillage of soil at the sides of the elevator but which also assist in rigidifying the apron assembly, such plates being alined with the apex between the sloping surfaces.

The construction is particularly durable, not only because of the inherent strength, and rigidity of the apron assembly but because it is well protected against damage due to obstructions and abrasion. Thus it will be noted that the apron actuators and hinge axis are located in protected position at a safely high level. No actuators, guides or ways are required under the scraper bowl, behind the discharge area or in similar vulnerable position as is the case with conventional scrapers particularly of the sliding floor type. Moreover, the floor structure may have a total thickness which is much less than where relatively sliding sections are used, enabling the floor level to be lowered for increased stability and capacity. Also, since the apron is rigid and freely swingable, with complete omission of rollers and slides, any cocking tendency is avoided.

Figure 7:
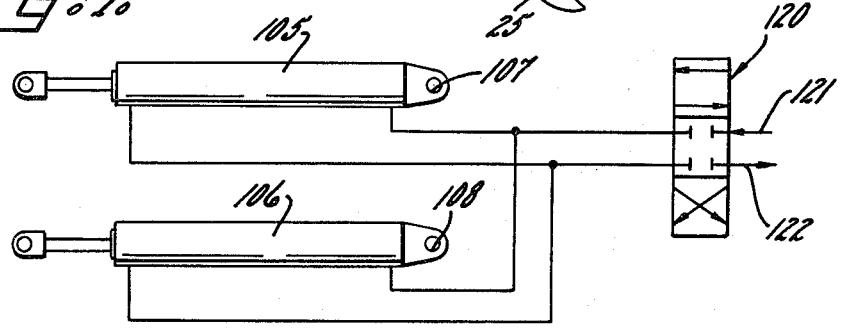
FIG. 7 is a simplified hydraulic diagram of the type employed to operate the various actuators in the system.

The hydraulic system for swinging the apron may be of rudimentary form, as illustrated in FIG. 7, employing a valve 120, diagrammatically illustrated as being of the slide type, fed by a pressure line 121 and exhausted by a sump line 122. Moving the valve to its extreme position causes the actuators 105, 106 to expand and contract for moving the apron to closed and open positions respectively or to any position in between. The same type of circuit is used for the bowl hoist cylinders 41, 42.

In accordance with one of the aspects of the present invention cam or stop surfaces are provided along the rear edge of the apron side plates for engaging a cam follower on the strike-off member 80 to move the latter between its horizontal and working conditions. Referring to FIG. 2, and taking the side plate 102 as representative, the cam and cam connection 130 includes an arcuate cam surface 131 and a cam follower roller 132, the latter being mounted upon a bracket 133 at the far end of the strike-off member. The parts are so formed and dimensioned that when the side plate 102 begins to move forwardly the cam surface 131 moves out of the way of the follower allowing the strike-off member to drop into working position, the position being determined by a pair of bottoming stops 134, 135. Conversely when the apron assembly is swung back into closed position, the cam surface 131, during the last portion of apron movement, intercepts the roller 132, camming the strike-off member 80 back into closed, transport position.

Turning to the means for coupling together the apron assembly and the frame of the elevator, a follower mechanism is used including cam type interengaging means on the apron and elevator frame. In the present embodiment this includes a cam roller 142 at the front upper corner of guide plate 112 cooperating with an angled cam track 143 which forms a part of the elevator frame, the structure being duplicated at each side of the frame (see also FIG. 6). Because of the interengaging surfaces clearance is at all times established between the elevator catenary and the blade which is mounted upon the apron. Thus, when the apron moves forwardly the elevator is cammed forwardly and upwardly about its swing axis 67. Alternatively, the bowl may be provided with fixed limit stops for the elevator frame, with the coupling mechanism coming into operation only after the apron 24 swings forwardly more than a predetermined amount, for example, beyond the point illustrated in FIG. 8.

In operation, then, with the bowl in closed condition as illustrated in FIG. 2, and with the elevator running, forward movement of the tractor causes soil to be loosened and lifted by the blade and ripper teeth. Engagement of the soil by the elevator flights causes it to pass upwardly along the sloping surface 91 of the apron, where it is confined by guide plates 111, 112, and with the elevator acting to deposit the soil in the back of the bowl. This process continues until the bowl is filled to capacity. The hoist cylinders 41, 42 are then contracted to tilt the bowl in the counterclockwise direction (as viewed in FIG. 1) thereby lifting the blade and ripper teeth out of the ground, following which the load may be transported at high speed to the point of dumping and distribution. Upon reaching the dumping area, valve 20 is shifted to expand the actuators 105, 106 so that the apron swings forwardly, that is, in a counterclockwise direction as viewed in FIG. 4.

The initial portion of this movement moves the cam surface 131 out of the way of the follower 132 permitting the strike-off member 80 to drop immediately into the illustrated working position. Forward swinging movement of the apron causes the blade 25 and ripper teeth 26 to be swung upwardly and, at the same time, the elevator is pressed by rollers 142, up into an out-of-the-way, clearance position. Where the soil is sandy, or dry and friable, the apron is swung to its open position only gradually for gradual discharge of the contents and with the discharged soil being leveled, full width, by the striker blade 82. Since forward rocking of the apron is accompanied by swinging retraction of the blade 25 upwardly and away from the ground the bowl may be rocked downwardly, by adjustment of actuators 41, 42, to achieve any desired "thinness" of the deposited layer. Since the operating position of the striker blade with respect to the bowl is fixed, the level of deposit is maintained with a much higher order of accuracy and constancy than is possible using a striker blade which is secured to a movable floor section. While it is true that tire deflection, as the load is gradually removed from the bowl, will cause a slight increase in level, this is so small as to be no source of concern and the level is, nevertheless, under operator control so that compensation may be made. It may also be noted that the striker blade, in addition to being hinged in a fixed position, is spaced sufficiently ahead of the rear wheels so that a wide range of striking depth is achieved within a limited range of tilt of the bowl.

To facilitate emptying of the bowl, particularly in the case of soils which are wet and clayey, the actuator 71 is expanded under control of a circuit similar to that shown in FIG. 7 causing the ejector plate 23 to move forwardly along the fixed floor 70. Because of the shortness of the longitudinal dimension of the fixed floor, and because of the fact that the elevator is swung clear of the advancing soil, and because of the large discharge opening provided by the apron 90 and strike-off member 80, there will be complete and prompt discharge even in the case of soils of "difficult" consistency.

Figure 8:
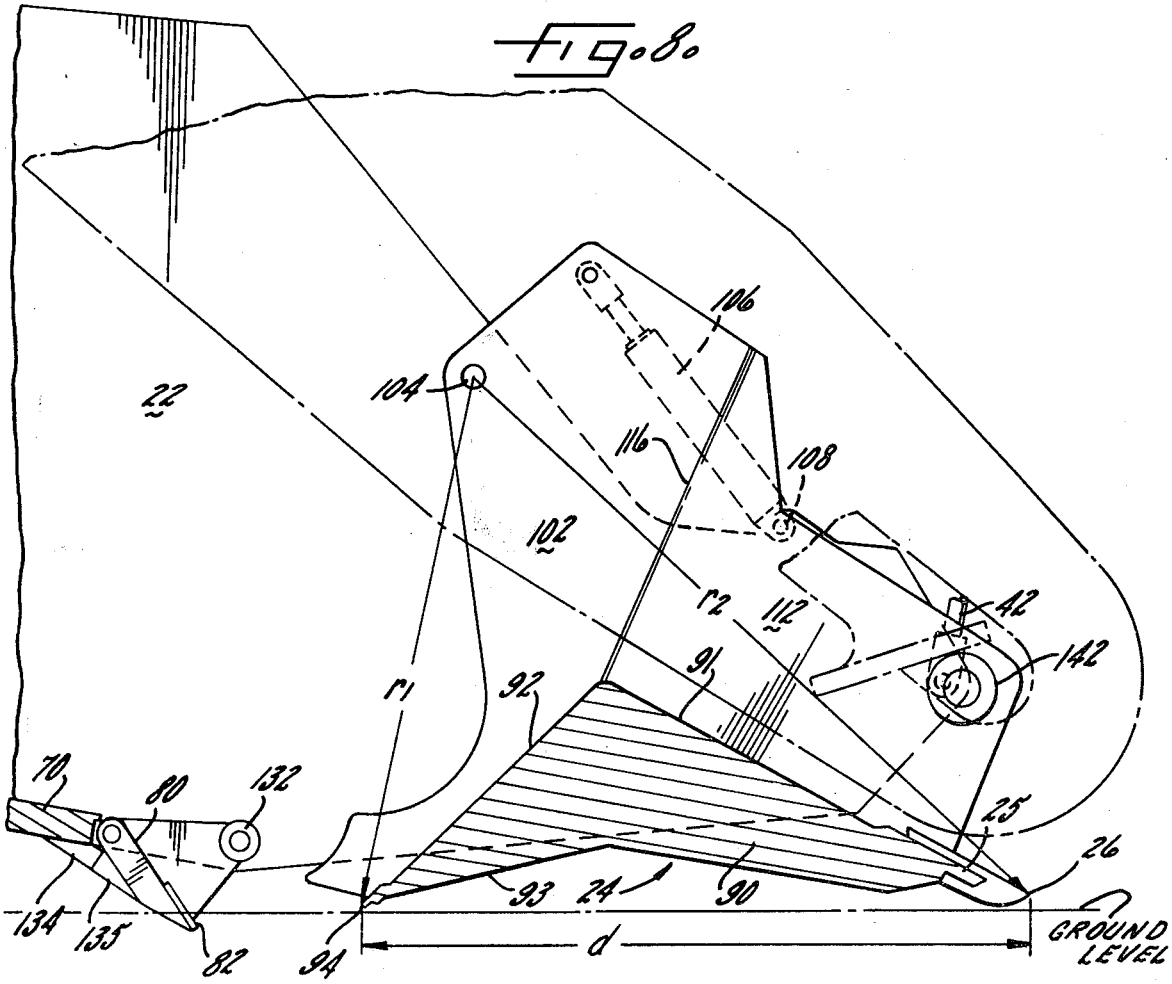
FIG. 8 is a view similar to FIG. 2 but showing an alternate scraping mode in which the regular scraper blade is retracted and in which the striker blade is employed, full width, for scraping purposes.

Use of the present structure is not limited to the loading and dumping modes set forth in FIGS. 2 and 4, respectively, and the strike-off membere may be employed, over the full width of the bowl, for final scraping of the type usually referred to as clean-up, and with the elevator fully effective to deposit the scraped soil in the back of the bowl. Thus in accordance with the invention, the apron axis, which is defined by pivots 103, 104 on the side plates, is located substantially to the rear of the blade 25 and preferably in a position above the rear edge of the apron. As a result when the apron is swung forwardly even a small amount, sufficient to create an opening ahead of the striker blade, the blade 25, and its associated ripper teeth, have a sufficiently large vertical component of movement to raise the blade and ripper teeth clear of the ground as shown in FIG. 8. Because of the axis location and the normal forward tilt of the apron body, referred to earlier, the rear edge of the apron is kept safely above ground level so that it does not interfere with the scraping action of the striker blade. A main advantage of the elevation of the scraper blade with only limited movement of the apron is that the elevator will remain in active working position so that it is effective in conveying and elevating into the bowl the soil scraped up by the striker blade.

In order to insure that the blade 25 has a substantial vertical component of motion the apron axis should not only be located rearwardly of the blade but it should not be too high. Preferably the average radius of swing of the apron should not greatly exceed the fore and aft dimension $d$ of the apron. Thus where the radius of the trailing edge of the apron is $r_1$, and the radius of the leading edge, or blade, is $r_2$, such radii should be chosen so that $(r_1 + r_2) \div 2$ does not greatly exceed $d$. Keeping the average radius on the order of $d$ enables the apron to be accommodated under the elevator without excessive displacement of the elevator.

To summarize: In the auxiliary full-width scraping mode, illustrated in FIG. 8, the apron 24 is swung forwardly a small amount, an amount sufficient to release the strike-off member 80 and an amount sufficient to move the regular scraper blade 25 and ripper teeth 26 clear of the ground, but an amount which is, nevertheless, so small that the elevator is retained in operating position. The bowl actuators are elongated so that the bowl tilts forwardly. The strike-off member is so dimensioned that it is capable of taking a shallow scraping cut with only moderate tilting of the bowl, and without, in any event, engaging the regular scraper blade, and its teeth, with the ground. While only a small amount of initial movement of the apron is effective to fully lower the striker blade, so that it may serve as a full-width scraper blade, such initial movement of the apron has very little effect upon the elevator, raising it only slightly. Thus during the full width scraping mode the apron, while opened slightly for admission of the scraped soil is still in a soil-retaining position, supporting the scraped soil adjacent the elevator, and the elevator is still in a low enough position for its flights to act efficiently on the soil supported by the apron.

As the striker blade 82 is drawn forwardly the scalped soil passes upwardly along the sloped strike-off member 80 and into the bowl where it accumulates, building up in height until the level is sufficient for engagement by the operating flights of the elevator; thereafter the loosened soil is deposited in the back of the bowl. The depth of cut, once set, remains constant but it is continually under the precise control of the operator. When the bowl is filled, the tractor is driven to the dumping area where the apron is swung, by actuators 105, 106, to its fully forward position, additionally raising the regular scraper blade 25 and the elevator to positions of clearance, and with the striking level, as previously discussed, being determined by the tilt of the bowl.

After dumping has been completed, the apron may be restored to the condition shown in FIG. 2, with automatic pick up of the strike-off member, automatic lowering of elevator and automatic restoration of the regular scraper blade and teeth to normal scraping position.

It will be apparent that the objects and advantages of the invention have been amply fulfilled with the device, as described, overcoming the disadvantages of scrapers of conventional design. The device has a utility and versatility not heretofore available but the structure is nontheless simple, economical, easily operated and substantially maintenance free. The machine combines the improvement in efficiency brought about by the taking of a deep narrow cut, and the capability of loading a wide range of materials, with the ability to spread an even layer over the full width of the bowl. And since spreading is accomplished by a strike-off member which is fixedly hinged, spreading will be at a constant depth from the beginning to the end of the load. This is to be contrasted with movable strike-off members in which spread depth usually increases as the load is dumped.

Also since the apron in the present design, and the strike-off member as well, may have a large fore and aft dimension, a large total discharge area is created greatly facilitating the dumping and spreading of materials of difficult, clayey consistency.

A primary advantage is, however, the high degree of versatility which the machine affords, its capability to take a deep cut with the main scraper blade for maximum earth moving capacity combined with the ability to take a shallower, full-width clean-up, or finish, cut, with the striker blade, followed in either event by spreading of the collected material in a wide layer as thin and precise as may be desired. The range and versatility, it may be noted, are achieved with a reduced range of bowl tilt as compared to more conventional designs of scrapers. A slight change in angle is all that is required to control the distribution level. Avoidance of large angles of tilt avoids the condition known as "tail dragging" in the travelling or leveling position, a condition in which the bowl is rocked so far back that the rear frame structure, which extends back beyond the rear axle, may strike obstructions on the ground. The limited angular bowl movement also maintains the tractor on a more even keel and brings about an economy in reducing the scope required in the body hoist cylinders and in reducing the relative movement of the various articulated parts, supply hoses and the like.

The term "incident to" as used herein refers to operations occurring, or caused to occur, at about the same time. The term "camming means" is intended to cover a mechanical connection in which movement of a first member (here the apron) is accompanied by coordinated movement of a second member over at least a portion of the movement of the first member. The term "upwardly" as applied to the draft members 17, 18 is related to the angular position of the bowl.

What is claimed is:

1. In an elevating type scraper for earth moving purposes, the combination comprising an open-fronted bowl including a pair of spaced vertical side sheets and a back wall as well including a pair of spaced vertical side sheets and a back wall as well as a floor extending between the side sheets at the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl in a normal enclosing position, a scraper blade at the front edge of the apron, an endless elevator at the front of the bowl having its lower end in proximity to the blade and inclined upwardly and rearwardly over the apron for conveying loosened soil from the blade into the bowl, a pivoted strike-off member at the front edge of the floor and having a striker blade extending therealong substantially the full width of the bowl, means for hingeing the strike-off member to the front edge of the floor for movement between a horizontal enclosing position and a downwardly angled working position, the floor, strike-off member and apron serving together to enclose the bottom of the bowl, the apron having vertical side plates lying adjacent the side sheets and pendulously pivoted thereto, actuator means for forwardly swinging the apron from its enclosing position to an open position to create a discharge opening ahead of the floor, first camming means interposed between the apron and the strike-off member actuated incident to the initial forward swinging movement of the apron for moving the striker blade to its working position for leveling of the material discharged through the opening, and second camming means interposed between the apron and the elevator for raising the elevator only slightly during the initial movement of the apron but for raising the elevator into a position in which the elevator flights are fully clear of the apron upon continued movement of the apron to its fully open position.

2. The combination as claimed in claim 1 in which the apron is of shallow triangular cross section presenting a forwardly sloping surface under the elevator and a rearwardly sloping surface extending adjacent to the striker blade when the apron is in its normal working position, the scraper blade being mounted at the front edge of the forwardly sloping surface.

3. The combination as claimed in claim 2 in which the triangular cross section has a bodily forward tilt so that the scraper blade is in a low scraping position when the apron is in its enclosing position, the pivot axis of the apron being located substantially to the rear of the scraper blade so that forward swing of the apron is accompanied by upward movement of the scraper blade into a position clear of the ground.

4. The combination as claimed in claim 1 in which the apron is of shallow triangular cross section presenting a forwardly sloping surface with the scraper blade along its front edge and a rearwardly sloping surface extending adjacent to the striker blade when the apron is in normal working position, the apron having a fore and aft dimension which approaches the fore and aft dimension of the floor so that when the apron is swung forwardly for discharge purposes, a discharge opening of substantial size is created ahead of the striker blade.

5. The combination as claimed in claim 1 in which the scraper blade occupies only the central portion of the apron and projects downwardly a substantial distance from the front edge thereof to provide a deep concentrated cut and in which the elevator has a width which substantially corresponds to the width of the blade, the apron having vertical guide plates spaced inwardly from the side plates to provide a relatively narrow central opening for registeringly receiving the elevator and for confining loosened soil as it is conveyed by the elevator.

6. The combination as claimed in claim 5 in which transversely extending closure plates are provided for structurally bridging the spaces between the apron side plates and the apron guide plates for enclosing such spaces thereby to insure that passage of the loosened soil is confined to the central opening of the apron.

7. The combination as claimed in claim 1 in which the elevator is mounted upon the bowl for forward swinging movement and in which inter-engaging stop surfaces are provided on the apron and on the elevator so that the elevator is swung forwardly in unison with forward swinging movement of the apron.

8. The combination as claimed in claim 1 in which the back wall is in the form of an ejector plate having an actuator and mounted for broadwise forward movement for facilitating discharge of the collected material through the discharge opening.

9. The combination as claimed in claim 1 in which the apron is provided at its rear edge with a stop surface and in which the strike-off member has a cooperating stop surface and so arranged that slight initial forward swing of the apron releases the strike-off member for movement from its horizontal enclosing position to its downwardly extending position and conversely so that final restoring movement of the apron moves the strike-off member back to horizontal enclosing position.

10. The combination as claimed in claim 1 in which the apron is provided at its rear edge with a cam surface and in which the strike-off member has a cam follower cooperating therewith and so arranged that slight initial forward swing of the apron releases the strike-off member for movement from its horizontal enclosing position to its working position and so that final restoring movement of the apron cams the strike-off member back to horizontal enclosing position.

11. The combination as claimed in claim 1 in which the apron is in the form of a transversely extending body of shallow triangular cross section presenting a forwardly sloping surface of shallow slope, a rearwardly sloping surface of shallow slope and a bottom surface, the fore-and-aft dimension of the apron body being a major portion of the fore-and-aft dimension of the floor, side plates of generally sector shape secured along their lower edges to the apron body and having alined pivots spaced above the rear portion of the apron for pendulous swinging movement of the apron between its enclosing position and its forwardly swung open position, the forwardly sloping surface of the apron having guide plates offset inwardly from the side plates to define a relatively narrow central opening, a scraper blade projecting from the central portion of the apron to provide a deep concentrated cut so that soil is loosened only in the region of the central opening, the elevator being of such width as to register with the central opening for sweeping the loosened soil along the guide plates and into the bowl.

12. In an elevating type scraper for earth moving purposes, the combination comprising an open-fronted bowl including a pair of spaced vertical side sheets and a back wall, as well as a floor extending between the side sheets at the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, bowl actuator means coupled to the front end of the bowl for selectively supporting it at a predetermined level with respect to the draft frame, an apron extending transversely between the side sheets in the front portion of the bowl in a normal enclosing position, a scraper blade at the front edge of the apron, means for pivoting the apron on the side sheets for forward swinging movement, an endless elevator at the front of the bowl having its lower end in proximity to the blade and inclined upwardly and rearwardly over the apron for conveying loosened soil from the blade into the bowl, a pivoted strike-off member at the front edge of the floor and having a striker blade extending therealong substantially the full width of the bowl, means for hingeing the strike-off member to the front edge of the floor for movement between a horizontal transport position and downwardly extending working position, the floor, strike-off member and apron serving together to enclose the bottom of the bowl, control means including an actuator for swinging the apron forwardly from its enclosing position to an open position to create a large discharge opening ahead of the floor for discharge of the material collected in the bowl and means coupled to the apron and responsive to the initial forward movement thereof for moving the striker blade to its working position for full-width leveling of the discharged material, the apron pivot axis being located substantially to the rear of the scraper blade so that only limited forward movement of the apron suffices to move the scraper blade to an upraised inactive position thereby permitting the striker blade, by movement of the bowl actuator means, to be lowered into shallow full-width scraping engagement with the ground.

13. The combination as claimed in claim 12 in which means are provided for keeping the elevator clear of the scraper blade during the limited forward movement of the apron while nevertheless preserving the proximity of the elevator to the soil scraped by the striker blade so that the scraped soil is piled up in the rear of the bowl.

14. The combination as claimed in claim 12 in which the elevator is mounted for forward and upward swinging movement and in which means are provided for moving the elevator automatically in unison with the movement of the apron to keep the elevator clear of the scraper blade while nevertheless preserving the proximity of the elevator to the soil scraped by the striker blade for piling up the latter in the bowl.

15. The combination as claimed in claim 12 in which the scraper blade occupies only the central portion of the apron and has associated teeth digging deeply into the soil to scrape a path which is only a fraction of the bowl width, the average radius of swinging movement of the apron being on the order of the fore-and-aft dimension of the apron so that the scraper blade is elevated out of ground engagement upon only limited movement of the apron, while enabling the apron to be accommodated under the elevator when fully swung to open position.

16. In a scraper for earth moving purposes, the combination comprising an open-fronted bowl including a pair of spaced vertical side sheets and a back wall as well as a floor extending between the side sheets in the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl in a normal enclosing position, a deep digging scraper blade at the front edge of the apron and occupying only the central portion of the front edge, a pivoted strike-off member at the front edge of the floor and having a striker blade extending therealong substantially the full width of the bowl, means for hingeing the strike-off member to the front edge of the floor for movement between a horizontal transport position and a downwardly projecting working position, the floor, strike-off member and apron serving together to enclose the bottom of the bowl, the apron having vertical side plates lying adjacent the side sheets and pendulously pivoted thereto, control means including an actuator for forwardly swinging the apron from its enclosing position to an open position to create a discharge opening ahead of the floor, and means coupled to the apron and actuated incident to the forward swinging movement of the apron for moving the striker blade to its working position for leveling of the material discharged through the opening.

17. The combination as claimed in claim 15 in which the back wall of the bowl is in the form of an ejector plate and has an associated actuator for movement of the material above the floor toward the discharge opening.

18. In a scraper for earth moving purposes, the combination comprising an open-fronted bowl including a pair of spaced vertical side sheets and a back wall as well as a floor extending between the side sheets in the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, bowl actuator means coupled to the front end of the bowl for selectively supporting it at a predetermined level with respect to the draft frame, an apron extending transversely between the side sheets in the front portion of the bowl in a normal enclosing position, a scraper blade at the front edge of the apron, a pivoted strike-off member at the front edge of the floor and having a striker blade extending therealong substantially the full width of the bowl, means for hingeing the strike-off member to the front edge of the floor for movement between a horizontal transport position and a downwardly projecting working position, the floor, strike-off member and apron serving together to enclose the bottom of the bowl, the apron being pivoted to the side sheets for swinging movement about a transverse axis, an apron actuator, and means coupled to the apron and actuated incident to the initial movement of the apron from its enclosing position for moving the striker blade to its working position for full-width leveling of the material discharged from the bowl, the apron axis being so located that upon movement of the apron the scraper blade is moved from a normal scraping position to an inactive position clear of the ground thereby permitting the striker blade, by movement of the bowl actuator means, to be lowered into shallow full-width scraping engagement with the ground.

19. The combination as claimed in claim 18 in which the back wall of the bowl is in the form of a forwardly shiftable ejector plate having an actuator for pressing the same forwardly to eject the collected material.

20. In an elevating type scraper for earth moving purposes, the combination comprising an open-fronted bowl including a pair of spaced vertical side sheets and a back wall as well as a floor extending between the side sheets at the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, bowl actuator means coupled to the front end of the bowl for selectively supporting it at a predetermined level with respect to the draft frame, an apron extending transversely between the side sheets in the front portion of the bowl in a normal enclosing position and pendulously pivoted to the side sheets, a relatively narrow endless elevator at the front of the bowl inclined upwardly and rearwardly over the apron and pivoted at its upper end for conveying loosened soil from the blade into the bowl, a pivoted strike-off member at the front edge of the floor and having a striker blade extending therealong substantially the full width of the bowl, means for hingeing the strike-off member to the front edge of the floor for movement between a horizontal transport position and a downwardly extending working position, the floor, strike-off member and apron serving together to enclose the bottom of the bowl during normal scraping and transport, the apron being formed of a pair of side plates interconnected by a transversely extending blade base of shallow triangular section having a rearwardly sloping surface which extends full width between the side plates and a forwardly sloping surface having a scraper blade at its front edge, the forwardly sloping surface having a pair of vertical guide plates spaced inwardly from the respective side plates for sharply narrowing the blade for reduction of scraping width and for forming the front of the apron into shovel shape in register with the elevator to facilitate taking of a deep, narrow cut, control means including an actuator for swinging the apron forwardly from its enclosing position to (*a*) a partially open position and (*b*) to a fully open and upwardly swung position, the pivot axis of the apron being located substantially to the rear of the scraper blade and camming means being interposed between the apron and the strike-off member so that upon initial movement of the apron to its partially open position (1) the scraper blade is lifted clear of the ground, (2) the striker blade is lowered to its working position and (3) a narrow soil-admitting opening is created ahead of the striker blade thereby enabling the striker blade to serve as a shallow full-width scraper while the scraper blade is disengaged from the ground, the elevator being positioned sufficiently close to the narrow soil-admitting opening as to elevate the soil flowing therethrough, the apron and elevator being mechanically coupled so that when the apron is moved to its fully open and upwardly swung position the elevator is swung upwardly to a position in which the elevator flights are clear of the apron at the same time that the apron opens a wide discharge opening for the soil collected in the bowl.

21. In a scraper for earth moving purposes, the combination comprising an open-fronted bowl including a pair of spaced vertical side sheets and a back wall as well as a floor extending between the side sheets in the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl in a normal enclosing position, a pivoted strike-off member at the front edge of the floor and having a striker blade extending therealong substantially the full width of the bowl, means for hingeing the strike-off member to the front edge of the floor for movement between a horizontal transport position and a downwardly projecting working position, the floor, strike-off member and apron serving together to enclose the bottom of the bowl, the apron having vertical side plates lying adjacent the side sheets and pendulously pivoted thereto for forward swinging movement of the apron from its enclosing position to an open position to create a discharge opening ahead of the floor, the back wall of the bowl being movable and having an actuator for ejecting the collected material, and means coupled to the apron and actuated incident to the initial portion of the forward swinging movement of the apron for moving the striker blade to its working position for leveling of the material discharged through the opening, the strike-off member being so dimensioned as to be capable of ground engagement by only slight lowering of the bowl thereby enabling the striker blade to serve as a full width scraper when the apron is swung toward open position for taking a shallow cut, the apron having a narrow scraper blade along its front edge engageable with the ground when the apron is closed for alternatively taking a deep but narrow cut, and actuator means for moving the apron between its closed and open positions.

22. In an elevating type scraper for earth moving purposes, the combination comprising an open-fronted bowl including a pair of spaced vertical side sheets and a back wall as well as a floor extending between the side sheets at the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl for normally enclosing the space ahead of the floor, a scraper blade extending along the front edge of the apron, an endless elevator at the front of the bowl having its lower end in proximity to the blade and inclined upwardly and rearwardly over the apron for conveying loosened soil from the blade into the bowl, a pivoted strike-off member at the front edge of the floor and having a striker blade extending therealong substantially the full width of the bowl, means for hingeing the strike-off member to the front edge of the floor for movement between a horizontal enclosing position and a downwardly extending position, the apron having vertical side plates lying adjacent the side sheets and pendulously pivoted thereto about a transversely extending swing axis, the apron having an actuator for forwardly swinging the apron from its enclosing position to a party open position, camming means interposed between the apron and the strike-off member for lowering the strike-off member from its horizontal enclosing position to its fully downwardly extending position to create a narrow opening ahead of the floor, the swing axis being located above the rear edge of the apron and substantially behind the scraper blade so that the limited amount of forward swing required to open up the narrow opening ahead of the floor suffices to lift the scraper blade clear of the ground thereby permitting the striker blade to be utilized for taking a shallow scraping cut, the elevator being in sufficient proximity to the striker blade when the apron occupies its partly open position so that the soil loosened by the striker blade is deposited by the elevator in the rear of the bowl.

23. In an elevating type scraper for earth moving purposes, the combination comprising an open-fronted bowl including a pair of spaced vertical side sheets and a back wall as well as well as a floor extending between the side sheets at the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl, a relatively narrow endless elevator at the front of the bowl having its lower end in proximity to the blade and inclined upwardly and rearwardly over the apron for conveying loosened soil from the blade into the bowl, the apron having a body which has a shallow triangular shape in longitudinal section presenting a forwardly sloping surface and a rearwardly sloping surface meeting at an apex, the forwardly sloping surface having substantially coextensive scraper blade at its front edge, the apron further having vertical side plates lying closely adjacent the respective bowl side sheets and pivoted to the latter fore-and-aft swinging movement, the rearwardly sloping surface extending full width from the lower edge of one side plate to the lower edge of the other, vertical guide plates at the ends of the forwardly sloping surface, the guide plates being generally parallel to the side plates and spaced inwardly therefrom to define a relatively narrow central opening of shovel shape which registeringly receives the elevator so that the soil which is loosened by the blade is conveyed up the forwardly sloping surface in a concentrated stream, closure plates for bridging the spaces between the side plates and the respective guide plates, and means for swinging the apron forwardly for dumping of the collected soil.

24. The combination as claimed in claim 23 in which the closure plates extend transversely in alinement with the apex between the forwardly and rearwardly sloping surfaces and integrally secured at the edges to the (*a*) side plates, (*b*) guide plates and (*c*) apex to provide a rigid apron assembly capable of resisting reaction at the blade when taking a deep cut.

* * * * *